US005092583A

United States Patent [19]

Rudolf

[11] Patent Number: 5,092,583

[45] Date of Patent: Mar. 3, 1992

[54] AEROBIC AND RESISTANCE EXERCISER

[76] Inventor: John L. Rudolf, 19 Bunker Rd., East Hanover, N.J. 07936

[21] Appl. No.: 627,331

[22] Filed: Dec. 14, 1990

[51] Int. Cl.[5] ..... A63B 5/20

[52] U.S. Cl. ..... 272/75; 272/DIG. 4

[58] Field of Search ..... 272/74, 75, 122, DIG. 4

[56] References Cited

U.S. PATENT DOCUMENTS

| | | | |
|---|---|---|---|
| 3,762,704 | 10/1973 | Gingras | 272/75 |
| 4,505,474 | 3/1985 | Mattox | 272/75 |
| 4,735,035 | 4/1988 | Mattioli | 272/75 |
| 4,743,016 | 5/1988 | Van Derworp et al. | 272/122 X |
| 4,919,417 | 4/1990 | Poulas | 272/75 |

FOREIGN PATENT DOCUMENTS

| | | | |
|---|---|---|---|
| 0010285 | 6/1909 | France | 272/75 |

*Primary Examiner*—Gene Mancene
*Assistant Examiner*—L. Thomas
*Attorney, Agent, or Firm*—Charles I. Brodsky

[57] ABSTRACT

The exerciser of the invention is of a type of apparatus generally classified as a "skip rope". However, instead of having a rope coupled between a pair of handles, the exerciser of the invention utilizes a length of hollow tubing in which an amount of metal shot is added to exert a pulling force on a user's muscles during a "skip" exercise. The tubing is also detachable from either or both of its handles, to adjustably permit shot to be further added or removed according to the strength of the person utilizing the exerciser and/or to adjust the length of the tubing according to the user's height. In a preferred embodiment of the invention, a pair of "stops" are incorporated at opposing positions on the tubing, so as to prevent the shot traveling from end-to-end, and so as to create a "shot-free" zone at that length of tubing which strikes the floor during the normal "skipping" exercise. In this preferred embodiment, additionally, a length of tubing of smaller diameter may alternatively be coupled between the "stops" in this "shot-free" zone, so as not only to promote a quieter environment when "skipping", but to also reduce the number of "misses" as the exerciser is being used.

12 Claims, 1 Drawing Sheet

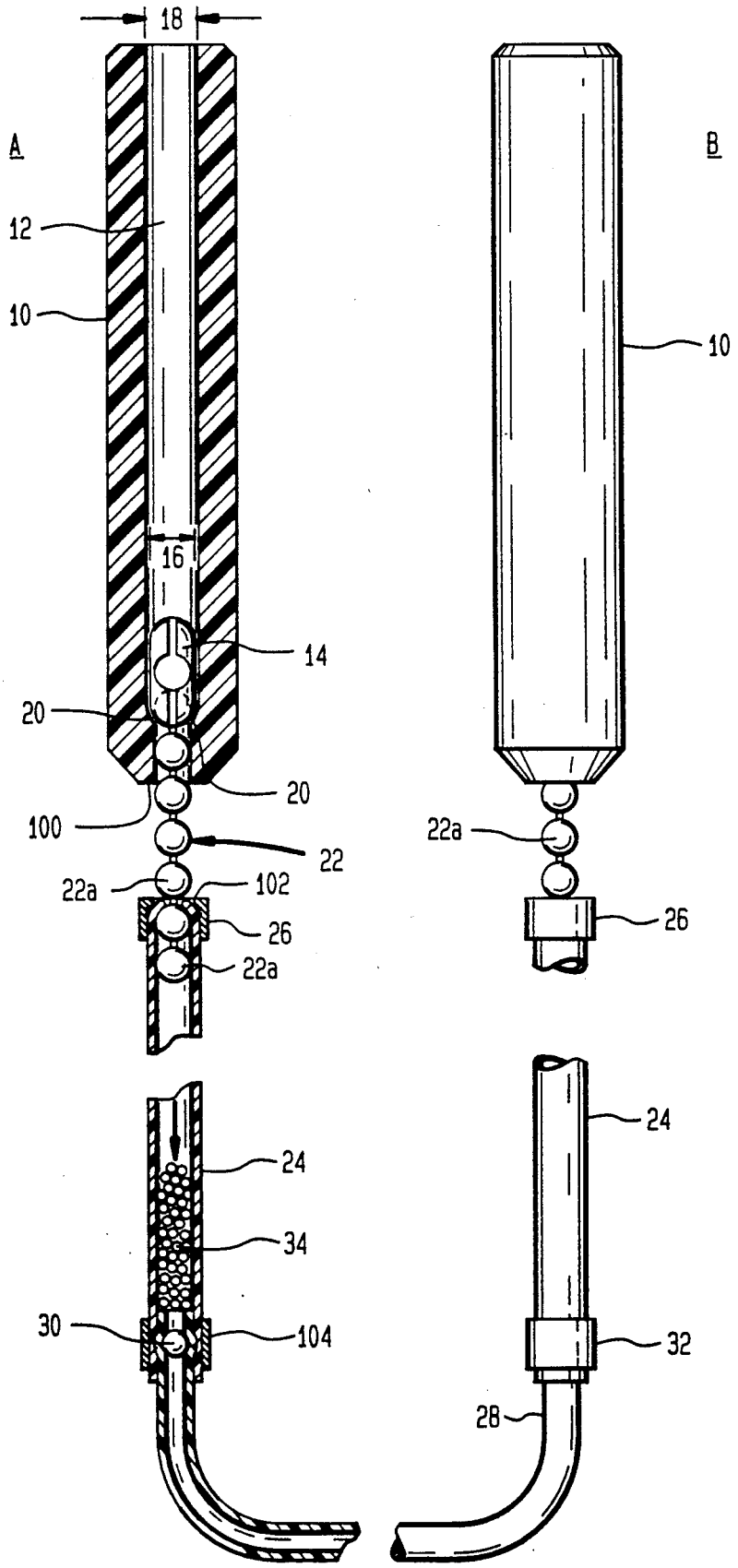
18
A
B
12
10
10
16
14
20
20
100
22
22a
102
26
22a
22a
26
24
24
34
30
104
32
28

AEROBIC AND RESISTANCE EXERCISER

FIELD OF THE INVENTION

This invention relates to exercise apparatus, in general, and to a combined aerobic and resistance type exerciser which is light enough and small enough for a user to take on trips to maintain optimum physical condition, in particular.

BACKGROUND OF THE INVENTION

As is well known and understood, we presently live in an age where health consciousness and physical conditioning are becoming ever more important. Fitness centers and health spas seems to be opening up almost weekly in every large city and suburb. Promoting such activities as an indoor-running track, various weightlifting equipment, stationary bicycles and indoor swimming pools, amongst other equipments, such businesses welcome clients ranging from a typical housewife to the business person and, in general, to people of all ages.

Not only are these locations opening and thriving, but they have also tended to generate interest in exercise equipments that can be purchased for use at home or office. Thus, one need only look through the pages of a newspaper or magazine, or turn on the television, to see advertisements promoting this or another stationary bicycle, this-or-that treadmill, any one of a number of "tummy-flattening" exercise apparatus and untold numbers of brands and models of running shoes. Recognizing that not everyone lives or works near a health fitness center, and that not everyone is able to travel to a shopping district or mall to purchase these home equipments, the industry has expanded into "mail-order", so that no one is more than a telephone call or letter away from purchasing the various apparatus extolled, so as to themselves obtain the body attractively depicted in the various media advertisements. Of course, and at the same time, there is competing tug in this modern age to have everything done and accomplished as quickly as possible. Thus, not only do people want diets to be effective overnight, but they desire the exercise equipment that they use to be able to burn-off calories as quickly as possible, and to obtain the desired degrees of fitness with the least amount of effort possible. Appreciating that many of these equipments available are not readily transportable from place to place, the participants in these exercise programs are also desirous of being able to take their equipment with them—if only going to the office, but always when taking an out-of-town trip, be it on business or vacation. While that is easily accomplished with taking one's pair of running shoes in an attache case or overnight bag, the activity associated with "running" is essentially entirely an "aerobic" exercise, without providing any "resistance" activities which are associated with weight-lifting, weight-pulling, rowing, or that wide class of exercising where one works against a resistance force.

SUMMARY OF THE INVENTION

As will become clear hereinafter, the exerciser of the present invention combines the benefits of aerobic and resistance type exercises into one, and in so doing at least in part reduces the time to burn-off the same amount of calories. As will also be seen, the exerciser of the invention produces less shock to the body parts than associated with "jogging" or "running" because, as will be noted below, use of the exerciser of the invention is one where the heel does not strike the ground while in use.

As will be seen, the exerciser of the invention is of a type of apparatus generally classified as a "skip rope". However, instead of a "rope" coupled between a pair of handles, the exerciser of the invention utilizes a length of hollow tubing in which an amount of metal shot is added to exert a pulling force on a user's muscles during a "skip" exercise. The tubing will be seen to be also detachable from either or both of its handles, to adjustably permit shot to be further added or removed according to the strength of the person utilizing the exerciser, and/or to adjust the length of the tubing according to the user's height. In a preferred embodiment of the invention, a pair of "stops" are incorporated at opposing positions in the tubing, so as to prevent the shot from traveling from end-to-end, and so as to create a "shot-free" zone at that length of tubing which strikes the floor during the normal "skipping" exercise. In this preferred embodiment, as will be seen, an alternative length of smaller diameter tubing may be connected between the pair of "stops", so as not only to provide a quieter environment when "skipping", but so that the smaller diameter of the tubing reduces the number of misses during the activity.

As will also be readily apparent, this combined aerobic and resistance exerciser will be light enough and small enough for the user to take along no matter the length of the trip, so as to maintain optimum physical condition. As will be apparent, by eliminating the metal shot from the area of the tubing that strikes the floor, a quieter exercise environment is promoted. Thus, when combining the aerobic-running activity with the resistance-weight-lifting exercise into one while performing this "skipping", a build-up of centrifugal force develops by virtue of the metal shot, effective in pulling on the muscles in an entire 360° direction, to tone up the entire body while the movement is being performed. Because the individual shot is in the nature of metal pellets—as will be described in more detail hereinafter—, its use becomes an easy way of finely adjusting the forces exerted by the apparatus of the invention, so as to permit its use both by men and by women, of varying age, size and strength.

BRIEF DESCRIPTION OF THE DRAWING

These and other features of the present invention will be more clearly understood from a consideration of the sole figure of the drawing which shows in partly-sectionalized form a preferred embodiment of the aerobic resistance exerciser constructed in accordance with the invention.

DETAILED DESCRIPTION OF THE DRAWING

A pair of handles 10 are shown in the drawing, which will be understood to incorporate a sectionalized-half as at A, and the actual appearance at the half B. Assemblable of any appropriate material or dimension, the handles according to the preferred embodiment of the invention may each be fabricated of wood, and of a 1" diameter a 6" length. As shown in the sectionalized-half A, the handles 10 are channeled, as at 12, to receive therein a splicer link 14 of cross-sectional diameter 16 slightly less than the diameter 18 of the channel 12. As shown, the channel 12 is inwardly angled to provide a bearing wall 20 against which the splicer link 14 abuts during the operation of the exerciser, so as to hold the splicer link 14 fast in place. In a preferred embodiment of the invention, the cross-sectional diameter 16 of the splicer link 14 was selected to be 0.345", while the cross-sectional diameter 18 of the channel 12 was selected of ⅜" diameter, thereby providing a free fit between the link 14 and the handle 10.

As is also shown in the sectionalized-half A, the channel 12 continues through the handle 10 up to 7/16" from an exit point 100 of a cross-sectional diameter substantial equal to the diameter of the splicer link 14. Into this end of the channel, i.e. at point 100, a ball chain 22 is coupled—one with each handle 10 and with each splicer link 14—to extend into and be grasped by the splicer link in secure attachment. As shown, a ball chain 22 of seven ball length is utilized, to serve as a multiple unit ball and socket swivel joint, and with the diameter of the individual balls being such as to snugly fit into the splicer link 14, with limited clearance so as to prevent the ball chain 22 from pulling out of the splicer link 14, and consequently prevented from pulling out of the handle 10. In accordance with the invention, seven balls are employed—which, because of their limited angular displacement within the splicer link 14 and channel 12 will be seen to form an arc in use that will keep all moving components of the aerobic resistance exerciser away from the user's hands, especially when a miss occurs during the "skipping" activity. In the preferred embodiment of the invention, as shown, two of the seven balls **22*a* of the chain 22 are attached inwardly of the handle 10 (one of which is secured inside the splicer link 14), with the remaining five balls extending outwardly therefrom so as to provide clearance for the user's hands. In this preferred embodiment, the diameter of the balls 22*a* of the chain 22** was selected of a ¼" diameter.

Also shown in the drawing—and particularly in the sectionalized-half A—, are a pair of lengths of flexible tubing 24 preferably constructed of polyvinylchloride of a nominal length of 44" each. In the preferred embodiment so far described, the tubing 24 is selected of an inside diameter ¼", but is more specifically selected to have an inside diameter substantially equal to the diameter of the balls **22*a* of the ball chain 22. In such manner, the balls 22*a* snugly fit inside the tubing 24—two such balls shown in the sectionalized-half A, and with the tubing 24** then having a larger outside diameter, which, for the embodiment being described, is selected of ⅜".

Surrounding the tubing 24, at the point where the balls **22*a* of the ball chain 22 couple is a partially threaded ferrule 26—one at each half A, B—, which permits the tube 24 to be positioned around the balls 22*a* in securing the tubing 24 to the ball chain 22. Conversely, to disconnect the tubing 24 from the ball chain 22, the partially threaded ferrule 26 is unscrewed, and ball chain 22 is then pulled out. As will be more clearly understood by those skilled in the art, this ferrule 26, with some of its internal threads removed, folds the tubing 24 over one or more balls 22*a* of the ball chain 22 when it is screwed on, to lock the tubing 24 and the ball chain 22 together. The partially removed thread will be seen to assist in the guiding of the ferrule 26 to be screwed-on co-linearly with the tubing 24**.

As also shown in the drawing, at the opposite end of the tubing —104 as compared to the end 102—a further, single piece of flexible tubing 28 is incorporated, to be inserted, at end 104 into each of the tubings 24. Such flexible tubing 28 may also be constructed of polyvinylchloride, but is selected to have an outer diameter which corresponds to the inner diameter of the tubing 24 so as to provide a snug fit between the two when the tubing 28 is inserted into the tubings 24. Thus, where the inner diameter of the tubings 24 was selected of ¼", the outer diameter of the tubing 28 was selected of the same ¼", and with an inner diameter for such additional tubing 28 being selected to be ⅛" in a manner to be explained below. Also shown in the drawing is a plastic ball 30 for insertion into the tubing 28 at the end 104—one plastic ball 30 for each end of the tubing 28—, and of a cross-sectional diameter substantially equal to the inner diameter of the tubing 28, in a close-fit relationship and so as to effectively block the tubing 28 from accepting any materials in the linear length of the tubing 28 which extends between the two plastic balls 30 when inserted in use. Additionally shown in the drawing is a crimping ferrule 32 encompassing the combination of the larger-diameter tubing 24, the smalled diameter tubing 28 inserted internally of it, and the plastic ball 30 inserted within the smaller-diameter tube 28. By crimping the ferrule 32, preferably constructed of a metallic composition, the tubing 24, the tubing 28, and the plastic ball 30 are all locked together, with the ball 30 then assuring that nothing present within the tubing 24 will make its way into the smaller diameter tubing 28.

In accordance with the teachings of the invention, once the tubing 24, the tubing 28, and the plastic ball 30 are locked together by the crimping ferrule 32, the construction of the exerciser of the invention can thus be completed. In the preferred embodiment being described, the ferrule 32 is selected to have an inner diameter of ⅛", substantially equal to the ⅛" outer diameter of the tubing 24—and with the outer diameter of the ferrule 32 and/or its length not being particularly critical in the operation of the invention.

Thus set up, the partially threaded ferrule 26 is then unscrewed, with the ball chain 22 then pulled out from the end 102 of the tubing 24. Into the tubing 24—at each sectionalized half A, B—, a series of metal shot pellets 34 are added, of No. 7½ size, and of a diameter that would otherwise pass inwardly of the tubing 28 were it not for the presence of the plastic ball 30 crimped by the ferrule 32 to block the opening. In accordance with the invention, approximately five ounces of such shot 34 are added at each half of the tubing 24, which—for the pellet size employed—represents approximately 500 individual pellets per side. Once the pellets are then in place, the ball chain 22 is reinserted into the tubing 24 at its end 102, and the threaded ferrule 26 then screwed back on to prevent the ball chain 22 from being pulled out when in use.

With the construction thus described, several things will be apparent to those skilled in the art. First of all, as the exerciser is being "skipped" the metal shot is propelled by centrifugal force to bear against the closed-off end 104 of the tubing 28, and in a "skipping" activity, produces a pull on the muscles of a user in all 360° of rotation as the exerciser is being twirled about during "skipping". Not only is an "aerobic" exercise of "skipping" being produced, but "resistance" exercise is produced as well, by virtue of having to twirl the weighted "rope" presented by the metallized pellet shot 34. Secondly, it will be seen that by periodically unscrewing the ferrule 26, additional shot pellets can be added—or removed—so as to adjust the resistance afforded, and so as to vary the strength needed according to the conditioning of the user—e.g. added shot could be inserted as the user continues to tone up his, or her, body, while shot could be removed when the exerciser is being used by a person of lesser strength or first taking up the exercise equipment. To this end, the preferred embodiment of the invention also comes with an added container of metallized shot pellets for the user to supplement the original ten ounces of shot initially inserted into the tubing 24.

Thirdly, it will be seen that the crimping ferrule 32 acts as a "stop" on each sectionalized-half A, B of the exerciser, to present a "shot-free" zone, which is particularly attractive in use as it is the length of tubing 28 which will strike the floor during the "skipping" operation. By eliminating any shot from this area, a quieter exercise environment is promoted. Fourthly, by having a smaller diameter tubing 28, the tendency for a user to "miss" while "skipping" is reduced as compared to a construction where the tubing 24 continues throughout the entire construction, even below the area of the crimping ferrule 32. Next, because each individual pellet of the shot 34 weighs so little in and of itself, a fine-tune adjustment is available for the forces exerted in using the exercising device, so that the resistance can be adjusted in small increments, just due to the addition of tens of pellets at a time to each sectionalized-half. Furthermore, in considering the ball chain 22, it will be appreciated that the limited angular displacement of each ball and link will be seen to describe an arc which at its smallest diameter continues still sufficiently large to keep the threaded ferrule 26 away from the user's hand while "skipping", so as to protect it in the event a miss occurs. And, obviously, by employing a flexible tubing 24, its length—and the resulting length of the "skip rope"—can be adjusted by merely cutting off a length of tubing on each side, as at the ends 102, so that the exerciser of the invention, once obtained for use by a taller person, can then be used by a shorter person as well. Of course, the length of the "skip rope" could also be controlled—either lengthening it or shortening it—by varying the number of balls **22*a* inserted into the tube 24 at its end 102 (e.g. such as four balls 22*a* instead of two as shown, to shorten it), but that is at the expense of increasing the possibility that a miss will cause the threaded ferrule 26 to strike the user's hands during "skipping". And, it will be readily apparent, that the exerciser of the invention as thus described combines the two activities of aerobic exercise and resistance training together, yet in an apparatus which can be light enough and small enough to easily pack and take along for future use. In obtaining all of this, the preferred embodiment of the invention, met all of these criteria, when utilizing the plastic tubing 24 to have a length of 44" at each half, and with an overall length for the tubing 28** of 22".

While there have been described what are considered to be preferred embodiments of the present invention, it will be readily appreciated by those skilled in the art that modifications can be made without departing from the scope of the teachings herein of providing an aerobic and adjustable resistance exercise device. Thus, the dimensions selected are for ease of operation, carrying about, and reduced cost. Obviously, other dimensions and fabrications can be employed—such as making the tubing in which the metallized shot is inserted of a single overall length, but crimped at its opposing ends to establish the "shot-free" zone where the tubing strikes the floor. Crimping-off such section will be understood to establish this "shot-free" zone, for a quieter operation, and for increased safety to the user, as contrasted with a situation where the shot continues to be able to flow from end-to-end, or where the tubing would incorporate a solid-weighted material. For at least such reasons, therefore, resort should be had to the claims appended hereto for a true understanding of the scope of the invention.

I claim:

1. Apparatus comprising;

a pair of handles;

a length of hollow tubing coupled between said handles;

a given amount of metal shot within said tubing and of a size to freely move from either one of said pair of handles towards the other one of said pair of handles; and means for detaching said tubing from at least one of said pair of handles to adjustably permit the addition or removal of shot to said tubing;

wherein there is also included means, at opposing positions on said tubing, for limiting the extent of free movement of shot from one of said pair of handles to the other of said pair of handles.

2. The apparatus of claim 1 wherein there is also included means, at at least one of said handles, for adjusting the length of said tubing coupled between said handles.

3. The apparatus of claim 2 wherein said included means are located at both of said handles for adjusting the length of said coupled tubing.

4. The apparatus of claim 3 wherein said included means includes a ball chain, having opposing ends of which snugly fit into each of said handles and an adjacent end of said hollow tubing.

5. The apparatus of claim 1 wherein said included means are positioned to create a "shot-free" zone at that area of said tubing furthest from said handles when said apparatus is grasped at said handles and allowed to hang down freely.

6. Apparatus comprising:

a pair of handles;

a first length of hollow tubing having an inner diameter $D_1$ and first and second ends;

a second length of hollow tubing having an inner diameter $D_2$ and first and second ends;

a third length of hollow tubing having an inner diameter $D_3$ and also having an outer diameter $D_4$ less than the inner diameters $D_1$ and $D_2$, with opposing ends of said third length of tubing respectively inserted into said first end of each of said first and second lengths of tubing;

a given amount of metal shot within said first and second lengths of tubing, and of a diameter less than the diameters $D_1$ and $D_2$ so as to be freely movable therein;

first means coupling said second ends of each of said first and second lengths of tubing to said pair of handles; and second means, at the insertion ends of said third length of hollow tubing into said first and second lengths of tubing, for preventing the movement of said shot from either of said first and second lengths of tubing into said third length of tubing;

and wherein said first means detachably couples at least one of said first and second lengths of tubing to said pair of handles.

7. The apparatus of claim 6 wherein said inner diameters $D_1$ and $D_2$ are substantially equal.

8. The apparatus of claim 6 wherein said shot is of a diameter greater than the inner diameter $D_3$ of said third length of hollow tubing.

9. The apparatus of claim 6 wherein said metal shot is of a diameter less than the inner diameter $D_3$ of said third length of hollow tubing, wherein ball means are incorporated within the ends of said third length of tubing at the points of insertion into said first and second lengths of tubing, and wherein means are further included for clinching together said ball means, said ends of said third length of tubing, and said first ends of said first and second lengths of hollow tubing.

10. The apparatus of claim 6 wherein said first means detachably couples said second ends of each of said first and second lengths of tubing to said handles for adjustably permitting the addition or removal of shot to said first and second lengths of tubing and for adjusting the lengths of said first and second tubing coupled between said pair of handles and said third length of tubing.

11. The apparatus of claim 6 wherein said first means includes a ball chain, having opposing ends which snugly fit into each of said handles and into said second ends of each of said first and second lengths of tubing.

12. Apparatus comprising:

a pair of handles;

a length of hollow tubing coupled between said handles;

a given amount of metal shot within said tubing and of a size to freely move from either one of said pair of handles towards the other one of said pair of handles;

means for detaching said tubing from at least one of said pair of handles to adjustably permit the addition or removal of shot to said tubing; and wherein there is also included means located at both of said handles for adjusting the length of said tubing coupled between said handles; and wherein said included means includes a ball chain, having opposing ends of which snugly fit into each of said handles and an adjacent end of said follow tubing.

* * * * *